US009121142B2

(12) United States Patent
Yano et al.

(10) Patent No.: US 9,121,142 B2
(45) Date of Patent: Sep. 1, 2015

(54) METHOD FOR WATERPROOFING SUBSTRATE

(71) Applicant: DYFLEX CORPORATION, Shinjuku-ku (JP)

(72) Inventors: Noriyoshi Yano, Funabashi (JP); Satoru Yoshida, Funabashi (JP)

(73) Assignee: DYFLEX CORPORATION, Tokyo (JP)

( * ) Notice: Subject to any disclaimer, the term of this patent is extended or adjusted under 35 U.S.C. 154(b) by 149 days.

(21) Appl. No.: 13/765,205

(22) Filed: Feb. 12, 2013

(65) Prior Publication Data

US 2014/0050525 A1 Feb. 20, 2014

Related U.S. Application Data

(63) Continuation of application No. PCT/JP2011/068471, filed on Aug. 12, 2011.

(30) Foreign Application Priority Data

Aug. 13, 2010 (JP) ..... 2010-181301

(51) Int. Cl.

| | |
|---|---|
| ***E01C 11/16*** | (2006.01) |
| ***E01D 19/08*** | (2006.01) |
| ***E01C 3/06*** | (2006.01) |
| ***E01C 7/32*** | (2006.01) |
| ***E01C 11/00*** | (2006.01) |

(52) U.S. Cl.

CPC ..... *E01C 11/165* (2013.01); *E01C 3/06* (2013.01); *E01C 7/325* (2013.01); *E01C 11/005* (2013.01); *E01D 19/083* (2013.01)

(58) Field of Classification Search

USPC ..... 404/28, 75, 31; 427/136

IPC ..... E01C 7/325

See application file for complete search history.

(56) References Cited

U.S. PATENT DOCUMENTS

| | | | | |
|---|---|---|---|---|
| 5,639,331 | A * | 6/1997 | Payne | 156/242 |
| 2002/0103268 | A1 | 8/2002 | Wiedermann et al. | |

(Continued)

FOREIGN PATENT DOCUMENTS

| | | | |
|---|---|---|---|
| CN | 1082062 | A | 2/1994 |
| JP | 2003-253608 | A | 9/2003 |
| JP | 2003-261907 | A | 9/2003 |
| JP | 2003-313817 | A | 11/2003 |
| JP | 2004-36325 | A | 2/2004 |
| JP | 2005-61057 | A | 3/2005 |
| JP | 2005-113376 | A | 4/2005 |
| JP | 4247071 | B2 | 4/2009 |

OTHER PUBLICATIONS

International Preliminary Report on Patentability (PCT/IB/373) dated Mar. 12, 2013, and English Translation of the Written Opinion (PCT/ISA/237) of the International Searching Authority dated Nov. 15, 2011, for International Application No. PCT/JP2011/068471.

(Continued)

*Primary Examiner* — Gary Hartmann

(74) *Attorney, Agent, or Firm* — Buchanan Ingersoll & Rooney PC

(57) ABSTRACT

A method for waterproofing a substrate, the method including adhering an adhesive member obtained by using an active hydrogen-containing synthetic resin, to a urethane-based waterproof layer to laminate a pavement adhesive layer; applying or spraying an isocyanate group-containing compound onto the pavement adhesive layer; and paving an asphalt mixture on the surface of the pavement adhesive layer.

22 Claims, 3 Drawing Sheets

(56) References Cited

U.S. PATENT DOCUMENTS

| | | | | |
|---|---|---|---|---|
| 2006/0245830 | A1* | 11/2006 | Woolstencroft et al. | 404/70 |
| 2011/0183100 | A1* | 7/2011 | Lee et al. | 428/41.8 |

OTHER PUBLICATIONS

*International Search Report (PCT/ISA/210) issued on Nov. 15, 2011, by the Japanese Patent Office as the International Searching Authority for International Application No. PCT/JP2011/068471.

*Written Opinion (PCT/ISA/237) issued on Nov. 15, 2011, by the Japanese Patent Office as the International Searching Authority for International Application No. PCT/JP2011/068471.

Office Action (Notification of the First Office Action) issued on Oct. 31, 2014, by the State Intellectual Property Office of People's Republic of China in corresponding Chinese Patent Application No. 201180038964.X and an English Translation of the Office Action. (14 pages).

* cited by examiner

METHOD FOR WATERPROOFING SUBSTRATE

RELATED APPLICATION(S)

This application claims priority as a continuation application under 35 U.S.C. §120 to PCT/JP2011/068471, which was filed as an International Application on Aug. 12, 2011 designating the U.S., and which claims priority to Japanese Application No. 2010-181301 filed in Japan on Aug. 13, 2010. The entire contents of these applications are hereby incorporated by reference in their entireties.

FIELD

The present disclosure relates to a method for waterproofing a substrate.

BACKGROUND INFORMATION

Deterioration and damage of a concrete substrate on roads and bridges are associated with fatigue phenomenon caused by repeated loading of automobile weight. Cracking occurs as a result of automobile weight during driving, and eventually concrete destruction occurs. In such a situation, if water, chlorides and carbon dioxide are ingressed in the concrete, deterioration is accelerated. In order to reduce or prevent this deterioration and damage, it can be necessary or beneficial to block rainwater, chloride and carbon dioxide which are supplied to the substrate, reduce the amounts thereof, and decrease the rate of supply. The substrate can be waterproofed. A method for this purpose can be paving of an asphalt mixture after waterproofing a substrate with asphalt.

Furthermore, methods for waterproofing a substrate which can provide higher durability have been suggested.

Japanese Patent Document No. 3956757 suggests a method in which a thermoplastic resin sheet is used as a pavement adhesive when a urethane-based waterproof layer and an asphalt pavement, and thereby improving the adhesiveness of the urethane-based waterproof layer and the asphalt pavement, while enhancing the construction applicability.

Furthermore, Japanese Patent Document No. 4247071 suggests a method in which a thermoplastic resin sheet has a cobweb shape or a non-woven fabric shape as a pavement adhesive, and thereby improves adhesive and workability.

Since the pavement adhesive used in Japanese Patent Document No. 3956757 comprises a thermoplastic resin sheet having a low softening point, there is a concern that the adhesive strength of the pavement adhesive may be decreased by an increase in the air temperature during the summer season.

The pavement adhesive used in Japanese Patent Document No. 4247071 comprises a thermoplastic resin sheet having a high softening point, and therefore, there is a problem with low temperature flexibility. Thus, there is a concern that the pavement adhesive may be hardened to an extent due to a decrease of the temperature during the winter season. The pavement adhesive may be destroyed by impact or repeated compression. In addition, since the pavement adhesive has high hardness, the pavement adhesive can have warpage in the edges of the sheet. Accordingly, it is difficult to apply the pavement adhesive to a construction, and there is also a problem with the adhesiveness to the adjacent layers.

SUMMARY

According to an exemplary aspect, disclosed is a method for waterproofing a substrate, the method comprising: adhering an adhesive member obtained by using an active hydrogen-containing synthetic resin, to a urethane-based waterproof layer, to form a pavement adhesive layer; applying or spraying an isocyanate group-containing compound onto the pavement adhesive layer; and paving an asphalt mixture above the pavement adhesive layer.

According to an exemplary aspect, disclosed is a waterproof substrate formed from a method for waterproofing a substrate, the method comprising: adhering an adhesive member obtained by using an active hydrogen-containing synthetic resin, to a urethane-based waterproof layer, to form a pavement adhesive layer; applying or spraying an isocyanate group-containing compound onto the pavement adhesive layer; and paving an asphalt mixture above the pavement adhesive layer.

According to an exemplary aspect, disclosed is a method for waterproofing a substrate, the method comprising: adhering an adhesive member, which comprises an active hydrogen-containing synthetic resin impregnated with an isocyanate group-containing compound, to a urethane-based waterproof layer, to form a pavement adhesive layer; and paving an asphalt mixture on a surface of the pavement adhesive layer.

According to an exemplary aspect, disclosed is a waterproof substrate formed from a method for waterproofing a substrate, the method comprising: adhering an adhesive member, which comprises an active hydrogen-containing synthetic resin impregnated with an isocyanate group-containing compound, to a urethane-based waterproof layer, to form a pavement adhesive layer; and paving an asphalt mixture on a surface of the pavement adhesive layer.

DETAILED DESCRIPTION

Figure 1:
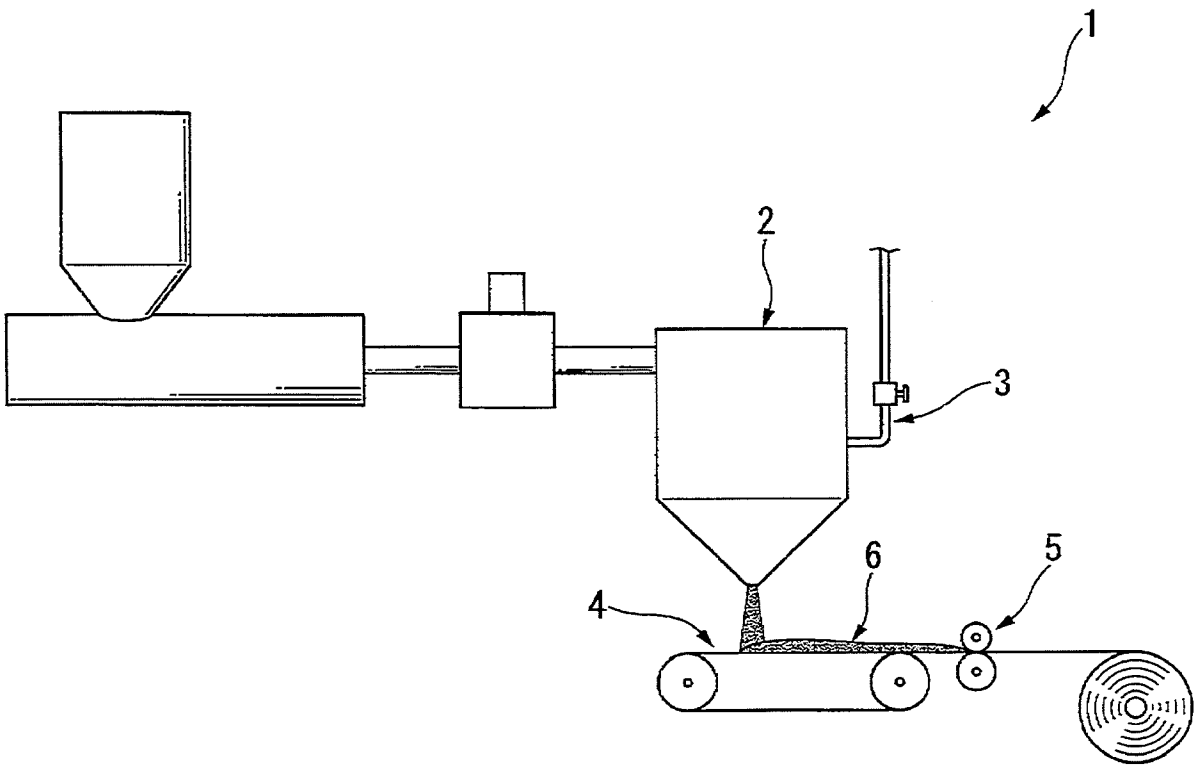
FIG. 1 is a structural diagram showing an extrusion apparatus for producing an adhesive member used in a method for waterproofing a substrate, in accordance with an exemplary aspect.

In accordance with an exemplary aspect, provided is an exemplary method for waterproofing a substrate which can provide a waterproofed substrate which has a low temperature flexibility in a low temperature environment, does not soften even in a high temperature environment, and retains adhesive strength in both of these environments.

In accordance with an exemplary aspect, an exemplary method for waterproofing a substrate comprises:

adhering an adhesive member obtained by using an active hydrogen-containing synthetic resin, to a urethane-based waterproof layer to laminate a pavement adhesive layer;

applying or spraying an isocyanate group-containing compound onto the pavement adhesive layer; and paving an asphalt mixture on the surface of the pavement adhesive layer.

In accordance with an exemplary aspect, an exemplary method for waterproofing a substrate of the disclosure comprises:

a step in which an adhesive member, which comprises an active hydrogen-containing synthetic resin, impregnated with an isocyanate group-containing compound, is adhered to a urethane-based waterproof layer to laminate a pavement adhesive layer; and paving an asphalt mixture on the surface of the pavement adhesive layer.

In an exemplary method for waterproofing a substrate, the active hydrogen-containing synthetic resin contains an ethylene-vinyl acetate copolymer resin.

In an exemplary method for waterproofing a substrate, a softening point of the active hydrogen-containing synthetic resin can be less than 60° C.

In an exemplary method for waterproofing a substrate, the adhesive member is in a woven fabric form, a non-woven fabric form, or a knitted form.

In an exemplary method for waterproofing a substrate, a molecular weight of the isocyanate group-containing compound is 800 or less.

According to an exemplary method for waterproofing a substrate, a waterproof substrate can be constructed which has excellent durability, maintains low temperature flexibility without hardening in a low temperature environment, does not soften in a high temperature environment, and maintains constant adhesive strength in both of these environments.

An exemplary embodiment of the waterproof substrate obtained by an exemplary method for waterproofing a substrate will be described.

In an exemplary aspect, the structure of the waterproof substrate is: concrete substrate/adhesive underlayer/urethane-based waterproof layer/adhesive interlayer/pavement adhesive layer/asphalt mixture.

In an exemplary method for waterproofing a substrate, first, the surface of a concrete substrate can be cleaned, washed and dried, and then a primer containing urethane-based resin, epoxy-based resin, vinyl acetate-based resin or the like is applied thereon as an adhesive underlayer. This adhesive underlayer applied on the surface of the concrete substrate adheres a urethane-based waterproof layer to the surface of the concrete substrate, which is a foundation. For this purpose, a primer containing a normal temperature-hardenable uncured urethane-based resin, or an epoxy resin can be used. The primer may be a one-liquid hardenable primer or a two-liquid hardenable primer.

A primer capable of adhering to a wetted surface can be employed, since the foundation may be moistened. Such a resin that can be used may be a resin that substantially does not foam in the presence of a degree of moisture constituting dampness, and a resin that is used as an adhesive for wet surface adhesion can be used. This primer can be applied by spraying a solution containing the primer with a spray gun or by coating the solution with a roller. The concentration of this solution may be appropriately selected in view of handleability or the like. The amount of the primer applied can be 0.1 to 0.5 kg/m$^2$, for example, 0.15 to 0.4 kg/m$^2$.

Subsequently, a waterproof material containing a urethane resin can be applied. In an exemplary embodiment, the primer surface does not have sand scattered over before the application of the waterproof material. The lamination of the urethane-based waterproof material is carried out by estimating a time with less traffic, such as nighttime, and blocking the traffic flow. In an exemplary embodiment, an ultrafast hardenable urethane can be used as the urethane-based waterproof material.

Examples of such an ultrafast hardenable polyurethane include EVERCOAT SP100, EVERCOAT SP200, PLAMAX 500, PLAMAX 1000, PLAMAX 2000, and PLAMAX 5000 (all trade names, manufactured by Dyflex Corp.).

In an exemplary embodiment, a urethane having flexibility can be used such that the waterproof layer can deform along the deformation of the substrate, such as bend, in order to prevent the waterproof layer from breaking. In the case of applying a waterproof material on the adhesive underlayer at a place where the traffic volume is low and mechanical coating is difficult, such as, for example, a parking lot, the application can be carried out by hand coating, and therefore, a resin that is not an ultrafast hardenable urethane may be exemplary in some cases. In regard to the application of a urethane waterproof material, application can be carried out by spraying with a spray gun or coating with a roller. In the case of spraying with a spray gun, a coating film may be formed by supplying a hardenable mixture formed by mixing an isocyanate component and a polyol component into the spray gun, and spraying the mixture on the adhesive underlayer. In addition, it is also possible to form a coating film by supplying separately an isocyanate component and a polyol component into a spray gun, and spraying the mixture, which is obtained by mixing the components in the spray gun, to the adhesive underlayer. In the case of coating with a roller, a hardenable mixture formed by mixing an isocyanate component and a polyol component can be applied. The urethane-based waterproof layer can be applied to a thickness of 0.3 to 5 mm, for example, about 1 to 3 mm.

On the urethane-based waterproof layer thus formed, a two-liquid hardenable type urethane-based resin adhesive can be applied as an adhesive interlayer. This two-liquid hardenable type urethane-based resin adhesive can have an affinity with the polyurethane forming the urethane-based waterproof layer, as well as an affinity with the pavement adhesive forming a layer thereabove. Examples of this two-liquid hardenable type urethane-based resin adhesive include resins which harden by a reaction between an isocyanate with a polyol or a polyamine. This two-liquid hardenable type urethane-based resin adhesive can be an adhesive that is uniformly applied on the urethane-based waterproof layer and thereby strongly adheres to the urethane-based waterproof layer, and can be integrated with the pavement adhesive that is constructed on the two-liquid hardenable type urethane-based resin adhesive before the adhesive hardens. Coating can be performed with a trowel or a roller when handleability upon coating is considered. The amount of the adhesive in the adhesive interlayer applied can be 0.1 to 1 kg/m$^2$, for example, 0.3 to 0.8 kg/m$^2$.

Before this adhesive interlayer hardens, for example, an adhesive member is constructed as a pavement adhesive layer.

The adhesive member for the pavement adhesive layer is not particularly limited. The adhesive member can be made of a synthetic resin having an active hydrogen. Examples of the synthetic resin having an active hydrogen include an ethylene-vinyl acetate copolymer, a partial saponification product of an ethylene-vinyl acetate copolymer, a thermoplastic polyurethane resin, a thermoplastic polyurea resin, a thermoplastic polyurethane-polyurea resin, a thermoplastic polyamide resin, and a copolymer of polyurethane and synthetic rubber. These resins may be used as a mixture of two or more of these, or may be made of a mixture with a polyethylene, a polypropylene, or an ethylene-vinyl acetate copolymer, which do not have an active hydrogen, and other resins. Furthermore, the active hydrogen-containing synthetic resin means a synthetic resin containing an active hydrogen group in the molecule, by having a hydroxyl group, a carboxyl group, an epoxy group, an amino group, a thiol group, an amide bond, a urea bond, a urethane bond, a biuret bond, an allophanate bond or the like.

The softening point of the resin used in the adhesive member can be equal to or higher than 40° C. and lower than 150° C., for example, equal to or higher than 40° C. and lower than 110° C., for example, equal to or higher than 40° C. and lower than 60° C. Such a softening point can be adjusted according to any suitable method of blending a resin having a high softening point and a resin having a low softening point.

From the viewpoint of the softening point and the reactivity with an isocyanate compound, the active hydrogen-containing synthetic resin can contain an ethylene-vinyl acetate copolymer resin.

Since an exemplary adhesive member can have a low softening point, the adhesive member maintains low temperature flexibility in a low temperature environment, and there is no cause for concern regarding extreme hardening caused by a decrease in the air temperature during the winter season or damage caused by impact or repeated compression. Furthermore, since an exemplary adhesive member has a low softening point, the adhesive member is flexible, and easily melts at the laying temperature during the laying of the asphalt mixture, thus having excellent construction applicability.

The adhesive member can be produced using a synthetic resin containing an active hydrogen so as to have spaces inside. As shown in FIG. 1, the adhesive member is formed to have spaces inside, by extruding the synthetic resin that has been melted, using an extrusion apparatus 1 at an extrusion temperature of approximately 100° C., so as to have spaces inside on a metal plate 4 while allowing a nozzle 2 to shake from side to side against an axis 3, and pressing while cooling the synthetic resin 6 with a stainless steel roller 5. An exemplary method of obtaining a synthetic resin having such a fibrous structure is called melt blowing (hereinafter, MB). The adhesive member can be formed into a woven fabric shape, a non-woven fabric shape, or a knitted shape. When the adhesive member has such a shape, there is no or reduced concern that air will be entrained upon bonding and cause swelling. Furthermore, when the adhesive member has such a shape, there is no or reduced concern that when the hole diameter of a venthole is enlarged or the number of ventholes is increased in order to solve the problem of swelling, the area of adhesion will decrease, or the adhesive strength will decrease.

Figure 2:
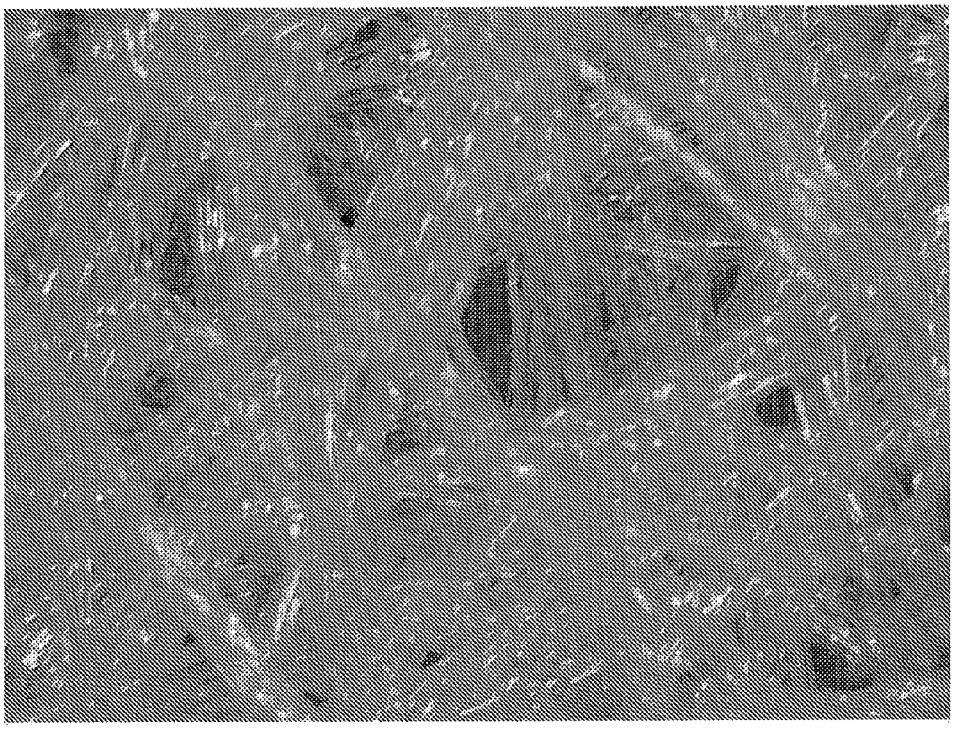
FIG. 2 is an electron microscope photograph of a non-woven fabric as an exemplary embodiment of an adhesive member used in a method for waterproofing a substrate, in accordance with an exemplary aspect.
Figure 3:
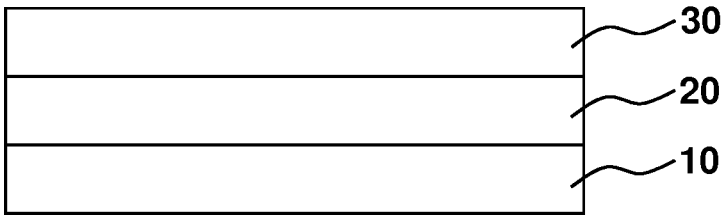
FIG. 3 is a drawling of an exemplary waterproof substrate including a pavement adhesive layer 10, an isocyanate group-containing compound 20, and an asphalt mixture 30.

FIG. 2 shows an electron microscope photograph of an exemplary adhesive member produced by molding a synthetic resin containing an active hydrogen by MB into a non-woven fabric form. The fiber diameter of the MB non-woven fabric shown in FIG. 2 is 2 μm in length, and is fine and uniform. Such an adhesive member has high flexibility and can be easily attach along the shape of the surface to be adhered.

In regard to the adhesive member, from the viewpoint of adhesiveness and construction applicability, the fiber density can be 100 g/m$^2$ to 2,000 g/m$^2$, for example, 500 g/m$^2$ to 1,500 g/m$^2$. From the viewpoint of reducing or preventing horizontal slipping of the adhesive member resulting from surface compaction or the like occurring during the spreading and leveling of the asphalt mixture, it is exemplary for the thickness of the adhesive member to not be very thick. For example, the thickness can be 0.1 mm to 2 mm, for example, 0.5 mm to 1.5 mm.

Such an adhesive member can be attached to the adhesive interlayer and pressed with a dedicated roller. As described above, the adhesive member can be formed to have spaces inside. For example, when a pavement adhesive layer including the adhesive member is pressed onto the adhesive interlayer, the adhesive of the adhesive interlayer fills the voids of the pavement adhesive layer and exhibits an anchor effect.

Subsequently, an isocyanate group-containing compound can be applied on the pavement adhesive layer. The method of application is not particularly limited, and may be carried out by spraying with a spray gun or by coating with a roller. The amount of coating can be at a proportion of 1% to 10%, for example, 2% to 7%, relative to the weight of the adhesive member. The isocyanate group-containing compound applied on the pavement adhesive layer can react with the adhesive of the adhesive interlayer, and chemical bonding can be formed between the two layers.

In an exemplary aspect, adhesion can be achieved more firmly, as compared to a fixing method between the two layers based on thumbtacking, or a fixing method based on sticking.

The pavement adhesive layer is formed using the synthetic resin containing an active hydrogen, and the isocyanate group-containing compound is coated onto the pavement adhesive layer. Therefore, the active hydrogen of the synthetic resin reacts with the isocyanate group of the isocyanate group-containing compound by the heat generated by laying an asphalt mixture which will be described later. Through this reaction, the pavement adhesive acquires the properties of a thermosetting resin. Accordingly, the pavement adhesive can maintain adhesive force without softening in a high temperature environment, such as the summer season when there is an increase in the air temperature. Therefore, according to an exemplary embodiment, the adhesive member of the pavement adhesive layer maintains durability in a high temperature environment, and displacement of asphalt due to the softening of the adhesive member does not occur or can be reduced.

Such an isocyanate group-containing compound is not particularly limited. The isocyanate group-containing compound has an isocyanate group. Examples of the isocyanate group-containing compound include aromatic isocyanate compounds such as diphenylmethane-4,4'-diisocyanate (MDI), polymethylene polyphenyl isocyanate (crude MDI), 2,4-tolylene diisocyanate (2,4-TDI), 2,6-tolylene diisocyanate (2,6-TDI), 1,5-naphthalene diisocyanate (NDI), and paraphenylene diisocyanate (PPDI); aromatic aliphatic isocyanate compounds such as 1,3- or 1,4-xylene diisocyanate (XDI); aliphatic isocyanate compounds such as hexamethylene diisocyanate (HDI), trimethylene diisocyanate and tetramethylene diisocyanate; alicyclic isocyanate compounds such as isophorone diisocyanate (IPDI), dicyclohexylmethane diisocyanate (hydrogenated MDI), and hydrogenated xylene diisocyanate; and dimers, trimers, carbodiimide-modification products, biuret-modification products, allophanate-modification products, adduct modification products and isocyanate group-terminated prepolymers using the isocyanate compounds mentioned above.

Furthermore, a blocked isocyanate compound having the isocyanate group masked with a phenolic compound (phenol, cresol, xylol, p-nitrophenol, alkylphenol, or the like) or an active methylene compound (methyl malonate, ethyl malonate, dimethyl malonate, diethyl malonate, acetylacetone, or the like), and a water-dispersible or water-soluble isocyanate compound using the isocyanate compound mentioned above can also be used.

These isocyanate compounds may be used individually, or two or more kinds may be used together.

As discussed above, the active hydrogen-containing resin of the pavement adhesive layer melts by the heat generated during the laying of an asphalt mixture, and reacts with the isocyanate compound impregnated therein to form a thermosetting resin.

In order to increase the impregnation properties of the isocyanate compound and meltability of the pavement adhesive during the reaction in the course of forming a thermosetting resin, the isocyanate group-containing compound can be a low-molecular-weight isocyanate group-containing compound, for example, diphenylmethane-4,4'-diisocyanate (MDI), polymethylene polyphenyl isocyanate (crude MDI), and a hexamethylene diisocyanate (HDI) trimer.

From the above point of view, the number average molecular weight of the isocyanate group-containing compound can be 800 or less, for example, 500 or less.

In regard to the lamination of the pavement adhesive layer, a product obtained by impregnating the adhesive member in advance with the isocyanate group-containing compound may also be used. In this case, the isocyanate group-containing compound that is used can be the low-molecular-weight isocyanate compound, as described above.

Furthermore, a blocked isocyanate compound may also be used. The blocked isocyanate compound has a urethane bond that is formed from a phenolic hydroxyl group or the like and an isocyanate group, and this urethane bond dissociates at high temperature. Therefore, in the case of using an adhesive member impregnated with a blocked isocyanate compound in the pavement adhesive layer, the active hydrogen originating from the synthetic resin and the isocyanate group originating from the isocyanate compound react with each other for the first time, when the adhesive member melts at the temperature of the laying of an asphalt mixture. From this point of view, an adhesive member impregnated with a blocked isocyanate compound can be exemplary in terms of construction applicability.

An exemplary method for waterproofing a substrate is not limited to the use as a substrate waterproofing technique. An exemplary method can be suitably used as a method for adhesion between an asphalt mixture and a urethane resin.

After the pavement adhesive layer is laminated, an asphalt mixture is laid to a thickness of, for example, about 40 to 200 mm. When the asphalt mixture is heated and pressed at, for example, over 100° C., the adhesive member therebelow melts, and the reaction described above occurs. Thus, the concrete substrate/adhesive underlayer/urethane-based waterproof layer/adhesive interlayer/pavement adhesive layer/asphalt mixture are bonded and integrated.

EXAMPLES

Hereinafter, the disclosure will be more specifically described based on Examples, Comparative Examples and Reference Examples. The disclosure is not intended to be limited to such examples.

Example 1

The surface of a foundation formed from a concrete slab for a pavement as defined in JIS A5304:94 was cleaned to remove dust, foreign matter and the like, and then an epoxy-based primer, "Primer PWF" (trade name, manufactured by Dyflex Corp.), was sprayed on the foundation in an application amount of 0.2 kg/m$^2$.

Subsequently, a two-liquid type ultrafast hardenable polyurethane, "Plamax 500" (trade name, manufactured by Dyflex Corp.), was sprayed with a spray gun in an application amount of 1.2 kg/m$^2$, and thus a polyurethane-based waterproof layer having a thickness of 1.2 mm was formed.

After this applied waterproof layer hardened, a two-liquid hardenable type urethane-based resin, "Resiprimer WG" (trade name, manufactured by Dyflex Corp.), was applied as the adhesive interlayer in an amount of 0.5 kg/m$^2$.

Subsequently, before this urethane-based primer hardened, a non-woven fabric having a fiber density of 800 g/m$^2$ was attached as the pavement adhesive layer, and the non-woven fabric was pressed with a dedicated roller.

The composition of the resin used in the non-woven fabric was 60% by mass of an ethylene-vinyl acetate copolymer resin, "Evaflex EV150" (trade name, manufactured by Du Pont-Mitsui Polychemicals Co., Ltd., melting point 61° C.), 30% by mass of an ethylene-vinyl acetate copolymer resin, "Evaflex EV40LX" (trade name, manufactured by DU Pont-Mitsui Polychemicals Co., Ltd., melting point 40° C.), and 10% by mass of an ethylene-vinyl alcohol copolymer resin, "Eval" (trade name, manufactured by Kurary Co., Ltd., melting point 160° C.). The softening point of the resin used in the non-woven fabric is 45° C.

Subsequently, a polymeric MDI, "Millionate MR-200" (trade name, manufactured by Nippon Polyurethane Industry Co., Ltd.), was sprayed using a spray gun on the surface of the pavement adhesive layer at a proportion of 5% relative to the weight of the non-woven fabric.

After the primer hardened, heated asphalt concrete was paved thereon to obtain a pavement thickness of 50 mm, and the asphalt concrete was cured for 24 hours after the paving. Thus, a construction test specimen was obtained.

Example 2

A construction test specimen was obtained in the same manner as in Example 1, except that a non-woven fabric having a fiber density of 500 g/m$^2$, which was formed by using a resin having a softening point of 45° C. and having a composition of 50% by mass of an ethylene-vinyl acetate copolymer resin, "Evaflex EV150" (trade name, manufactured by Du Pont-Mitsui Polychemicals Co., Ltd., melting point 61° C.), 45% by mass of an ethylene-vinyl acetate copolymer resin, "Evaflex EV40LX" (trade name, manufactured by Du Pont-Mitsui Polychemicals Co., Ltd., melting point 40° C.), and 5% by mass of an ethylene-vinyl alcohol copolymer resin, "Eval" (trade name, manufactured by Kuraray Co., Ltd., melting point 160° C.), was used and an HDI trimer, "Coronate HXR" (trade name, manufactured by Nippon Polyurethane Industry Co., Ltd.) was sprayed at a proportion of 5% relative to the weight of the non-woven fabric.

Example 3

A construction test specimen was obtained in the same manner as in Example 1, except that a non-woven fabric having a fiber density of 1,000 g/m$^2$, which was formed by using a resin having a softening point of 45° C. and having a composition of 60% by mass of an ethylene-vinyl acetate copolymer resin, "Evaflex EV150" (trade name, manufactured by Du Pont-Mitsui Polychemicals Co., Ltd., melting point 61° C.), 30% by mass of an ethylene-vinyl acetate copolymer resin, "Evaflex EV40LX" (trade name, manufactured by Du Pont-Mitsui Polychemicals Co., Ltd., melting point 40° C.), and 10% by mass of a thermoplastic polyurethane resin, "Miractran 22MR" (trade name, manufactured by Nippon Miractran Co., Ltd., melting point 110°), was used.

Example 4

A construction test specimen was obtained in the same manner as in Example 1, except that a non-woven fabric having a fiber density of 800 g/m$^2$, which was formed by using a resin having a softening point of 49° C. and having a composition of 80% by mass of an ethylene-vinyl acetate copolymer resin, "Evaflex EV40LX" (trade name, manufactured by Du Pont-Mitsui Polychemicals Co., Ltd., melting point 40° C.), and 20% by mass of an ethylene-vinyl alcohol copolymer resin, "Eval" (trade name, manufactured by Kurary Co., Ltd., melting point 160° C.), was used and an HDI allophanate, "Coronate 2770" (trade name, manufactured by Nippon Polyurethane Industry Co., Ltd.) was sprayed at a proportion of 5% relative to the weight of the non-woven fabric.

Example 5

A construction test specimen was obtained in the same manner as in Example 1, except that a non-woven fabric having a fiber density of 800 g/m$^2$, which was formed by using a resin having a softening point of 45° C. and having a composition of 50% by mass of an ethylene-vinyl acetate copolymer resin, "Evaflex EV150" (trade name, manufactured by Du Pont-Mitsui Polychemicals Co., Ltd., melting point 61° C.), and 50% by mass of a thermoplastic polyurethane resin, "Miractran 22MR" (trade name, manufactured by Nippon Miractran Co., Ltd., melting point 110° C.), was used and a urethane prepolymer "DS Collar" main agent (trade name, manufactured by Dyflex Corp.) was sprayed at a proportion of 5% relative to the weight of the non-woven fabric.

Example 6

A construction test specimen was obtained in the same manner as in Example 1, except that a non-woven fabric having a fiber density of 200 g/m$^2$, which was formed by using a resin having a softening point of 45° C. and having a composition of 60% by mass of an ethylene-vinyl acetate copolymer resin, "Evaflex EV150" (trade name, manufactured by Du Pont-Mitsui Polychemicals Co., Ltd., melting point 61° C.), 30% by mass of an ethylene-vinyl acetate copolymer resin, "Evaflex EV40LX" (trade name, manufactured by Du Pont-Mitsui Polychemicals Co., Ltd., melting point 40° C.), and 10% by mass of an ethylene-vinyl alcohol copolymer resin, "Eval" (trade name, manufactured by Kuraray Co., Ltd., melting point 160° C.), was used.

Example 7

A construction test specimen was obtained in the same manner as in Example 1, except that a perforated sheet having a fiber density of 800 g/m$^2$, which was formed by using a resin having a softening point of 45° C. and having a composition of 65% by mass of an ethylene-vinyl acetate copolymer resin, "Evaflex EV150" (trade name, manufactured by Du Pont-Mitsui Polychemicals Co., Ltd., melting point 61°), 30% by mass of an ethylene-vinyl acetate copolymer resin, "Evaflex EV40LX" (trade name, manufactured by Du Pont-Mitsui Polychemicals Co., Ltd., melting point 40° C.), and 5% by mass of a polyamide, "Macromelt 6830" (trade name, manufactured by Henkel Japan, Ltd., melting point 160° C.), was used and a polymeric MDI, "Millionate MR-200" (trade name, manufactured by Nippon Polyurethane Industry Co., Ltd.) was sprayed at a proportion of 5% relative to the weight of the perforated sheet.

Example 8

A construction test specimen was obtained in the same manner as in Example 1, except that a non-woven fabric having a fiber density of 800 g/m$^2$, which was formed by using a resin having a softening point of 57° C. and having a composition of 90% by mass of an ethylene-vinyl acetate copolymer resin, "Evaflex EV450" (trade name, manufactured by Du Pont-Mitsui Polychemicals Co., Ltd., melting point 84° C.), and 10% by mass of an ethylene-vinyl alcohol copolymer resin, "Eval" (trade name, manufactured by Kuraray Co., Ltd., melting point 160° C.), was used.

Comparative Example 1

A construction test specimen was obtained in the same manner as in Example 1, except that a non-woven fabric having a fiber density of 800 g/m$^2$, which was formed by using a resin having a softening point of 32° C. and having a composition of 100% by mass of an ethylene-vinyl acetate copolymer resin, "Evaflex EV150" (trade name, manufactured by Du Pont-Mitsui Polychemicals Co., Ltd., melting point 61° C.), was used and nothing was sprayed on the surface of the pavement adhesive layer.

Comparative Example 2

A construction test specimen was obtained in the same manner as in Example 1, except that a non-woven fabric having a fiber density of 800 g/m$^2$, which was formed by using a resin having a softening point of 30° C. and having a composition of 100% by mass of an ethylene-vinyl acetate copolymer resin, "Evaflex EV40LX" (trade name, manufactured by Du Pont-Mitsui Polychemicals Co., Ltd., melting point 40° C.), was used and nothing was sprayed on the surface of the pavement adhesive layer.

Comparative Example 3

A construction test specimen was obtained in the same manner as in Example 1, except that a non-woven fabric having a fiber density of 800 g/m$^2$, which was formed by using a resin having a softening point of 52° C. and having a composition of 100% by mass of an ethylene-vinyl acetate copolymer resin, "Evaflex EV450" (trade name, manufactured by Du Pont-Mitsui Polychemicals Co., Ltd., melting point 84° C.), was used and nothing was sprayed on the surface of the pavement adhesive layer.

Comparative Example 4

A construction test specimen was obtained in the same manner as in Example 1, except that a perforated sheet having a fiber density of 800 g/m$^2$, which was formed by using a resin having a softening point of 52° C. and having a composition of 100% by mass of an ethylene-vinyl acetate copolymer resin, "Evaflex EV450" (trade name, manufactured by Du Pont-Mitsui Polychemicals Co., Ltd., melting point 84° C.), was used and nothing was sprayed on the surface of the pavement adhesive layer.

Comparative Example 5

A construction test specimen was obtained in the same manner as in Example 1, except that a cobweb-like sheet having a fiber density of 800 g/m$^2$, which was formed by using a resin having a softening point of 160° C. and having a composition of 100% by mass of a polyamide, "Macromelt 6830" (trade name, manufactured by Henkel Japan, Ltd., melting point 160° C.), was used and nothing was sprayed on the surface of the pavement adhesive layer.

Comparative Example 6

A construction test specimen was obtained in the same manner as in Example 1, except that a non-woven fabric having a fiber density of 900 g/m$^2$ (laminate of 3 sheets of 300 g/m$^2$), which was formed by using a resin having a softening point of 80° C. and having a composition of 100% by mass of a polyurethane, "Espansione" (trade name, manufactured by Kanebo Cosmetics, Inc., melting point 135° C.), was used and nothing was sprayed on the surface of the pavement adhesive layer.

Comparative Example 7

A construction test specimen was obtained in the same manner as in Example 1, except that a non-woven fabric having a fiber density of 800 g/m$^2$ (laminate of 8 sheets of 100 g/m$^2$), which was formed by using a resin having a softening point of 150° C. and having a composition of 100% by mass of polypropylene, "PC0100" (trade name, manufactured by Kuraray Co., Ltd., melting point 170° C.), was used and nothing was sprayed on the surface of the pavement adhesive layer.

Comparative Example 8

A construction test specimen was obtained in the same manner as in Example 1, except that a non-woven fabric having a fiber density of 690 g/m$^2$ (laminate of 10 sheets of 69 g/m$^2$), which was formed by using a resin having a softening point of 230° C. and having a composition of 100% by mass of a polyester, "FM070B" (trade name, manufactured by Kuraray Co., Ltd., melting point 200° C. or higher), was used and nothing was sprayed on the surface of the pavement adhesive layer.

The properties of Examples 1 to 8 and Comparative Examples 1 to 8 were measured by the following test methods based on the Design Guidelines published by Nippon Expressway Co., Ltd. (Vol. 2, Bridge Construction, April 2010), and the results are presented in Tables 1-1 and 1-2.

(1) Adhesive Strength

A tensile test was performed at −10° C., 23° C. and 50° C. using a Kenken-type vertical tensile tester, with the asphalt laying temperature set at 140° C. (the reference values for the adhesive strength in the Design Guidelines are 1.2 N/mm$^2$ or higher, 0.6 N/mm$^2$ or higher, and 0.07 N/mm$^2$ or higher under the conditions of −10° C., 23° C. and 50° C., respectively).

(2) Low Temperature Construction Applicability

A tensile test was performed at 23° C. using a Kenken-type vertical tensile tester, with the asphalt laying temperature set at 110° C. (the reference value for the adhesive strength in the Design Guidelines is 0.6 N/mm$^2$ or higher).

(3) Low Temperature Flexibility

A 180°-bending test was performed at −10° C. The results were rated as good when flexibility was observed, and as bad when the specimen was broken.

TABLE 1

| | | Example 1 | Example 2 | Example 3 | Example 4 | Example 5 | Example 6 | Example 7 | Example 8 |
|---|---|---|---|---|---|---|---|---|---|
| Adhesion strength (N/mm$^2$) | −10° C. | 2.50 | 2.20 | 1.93 | 2.10 | 1.98 | 1.35 | 1.75 | 1.35 |
| | 23° C. | 1.93 | 1.45 | 1.61 | 1.58 | 1.65 | 1.25 | 1.65 | 1.50 |
| | 50° C. | 0.23 | 0.14 | 0.19 | 0.15 | 0.25 | 0.19 | 0.17 | 0.23 |
| Low temperature construction applicability (N/mm$^2$) | 23° C. | 1.83 | 1.56 | 1.51 | 1.65 | 1.67 | 1.26 | 1.55 | 1.10 |
| Low temperature flexibility | | good | good | good | good | good | good | good | good |

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Adhesion strength (N/mm$^2$) | −10° C. | 1.52 | 1.63 | 1.49 | 1.50 | 0.20 | 1.01 | 0.30 | 0.10 |
| | 23° C. | 1.40 | 0.75 | 1.00 | 1.00 | 0.60 | 0.60 | 0.40 | 0.30 |
| | 50° C. | 0.10 | 0.07 | 0.07 | 0.06 | 0.03 | 0.04 | 0.01 | 0.01 |
| Low temperature construction applicability (N/mm$^2$) | 23° C. | 0.65 | 1.05 | 0.45 | 0.45 | 0.10 | 0.10 | 0.10 | 0.08 |
| Low temperature flexibility | | good | good | good | good | bad | good | good | good |

As shown in Table 1, the construction test specimens obtained in Examples 1 to 8 were superior in adhesive strength, low temperature construction applicability and low temperature flexibility in high temperature and low temperature environments, as compared with the construction test specimens obtained in Comparative Examples 1 to 8. Comparative Examples 6 to 8 exhibited low values for both the adhesive strength (asphalt laying temperature 140° C.) and low temperature construction applicability (asphalt laying temperature 110° C.).

Furthermore, the properties of Examples 1 to 8 and Comparative Examples 1 to 8 were measured by the following test methods.

(4) Seasonal Stability

The same test as that of item (1) was performed, and the adhesive strengths for different seasons were measured.

Thus, changes in the adhesive strength generated by the temperature change occurring with the change of season were investigated.

Changes in the adhesive power were not observed in Examples 1 to 8. In Comparative Examples 1 to 4, the construction test specimens were softened in the summer season, and a decrease in the adhesive power was observed. In Comparative Example 5, the construction test specimen was hardened in the winter season and was destroyed by impact. In Comparative Examples 6 to 8, the pavement adhesive material layer was confirmed to be in an unfused state in the winter season.

(5) Construction Applicability

In Examples 1 to 8 and Comparative Examples 1 to 3 and 8, the construction applicability was good. In Comparative Examples 4, 6 and 7, air was entrained during construction, and swelling appeared on the surface of the pavement adhesive. Furthermore, in Comparative Example 5, since the cobweb-like sheet was hard, it was difficult to bond the cobweb-like sheet uniformly.

Disclosed is an exemplary method for waterproofing a substrate including a step in which an adhesive member obtained by using an active hydrogen-containing synthetic resin is adhered to a urethane-based waterproof layer to laminate a pavement adhesive layer; applying or spraying an isocyanate group-containing compound onto the pavement adhesive layer; and paving an asphalt mixture on the surface of the pavement adhesive layer.

According to an exemplary method for waterproofing a substrate of the disclosure, a waterproof substrate can be constructed which has excellent durability, maintains low temperature flexibility without hardening in a low temperature environment, does not soften in a high temperature environment, and maintains constant adhesive strength in both of these environments.

EXPLANATION OF REFERENCE NUMERALS

1: extrusion apparatus
2: nozzle
3: axis
4: metal plate
5: stainless steel roller
6: synthetic resin While exemplary embodiments have been described and illustrated above, it should be understood that these embodiments are exemplary. Additions, omissions, substitutions, and other modifications can be made without departing from the spirit or scope of the present disclosure. Accordingly, the disclosure is not to be considered as being necessarily limited by the foregoing description.

It will be appreciated by those skilled in the art that the present disclosure can be embodied in other specific forms without departing from the spirit or essential characteristics thereof. The presently disclosed embodiments are therefore considered in all respects to be illustrative and not restricted. The scope of the disclosure is indicated by the appended claims rather than the foregoing description and all changes that come within the meaning and range and equivalence thereof are intended to be embraced therein.

What is claimed is:

1. A method for waterproofing a substrate, the method comprising:

adhering an adhesive member obtained by using an active hydrogen-containing synthetic resin, to a urethane-based waterproof layer, to form a pavement adhesive layer;

applying or spraying an isocyanate group-containing compound onto the pavement adhesive layer; and paving an asphalt mixture above the pavement adhesive layer.

2. The method for waterproofing a substrate according to claim 1, wherein the active hydrogen-containing synthetic resin contains an ethylene-vinyl acetate copolymer resin.

3. The method for waterproofing a substrate according to claim 1, wherein a softening point of the active hydrogen-containing synthetic resin is lower than 60° C.

4. The method for waterproofing a substrate according to claim 1, wherein the adhesive member is in a woven fabric form, a non-woven fabric form, or a knitted form.

5. The method for waterproofing a substrate according to claim 1, wherein the molecular weight of the isocyanate group-containing compound is 800 or less.

6. The method for waterproofing a substrate according to claim 1, wherein a thickness of the adhesive member is 0.1 mm to 2 mm.

7. The method for waterproofing a substrate according to claim 1, wherein the adhesive member is adhered to the urethane-based waterproof layer using an adhesive interlayer positioned between the adhesive member and the urethane-based waterproof layer.

8. The method for waterproofing a substrate according to claim 7, wherein the adhesive member is adhered to the urethane-based waterproof layer before the adhesive interlayer hardens.

9. The method for waterproofing a substrate according to claim 1, wherein the active hydrogen originating from the active hydrogen-containing synthetic resin and the isocyanate group originating from the isocyanate group-containing compound react with each other for the first time when the adhesive member melts due to the application of the asphalt mixture.

10. A waterproof substrate formed from the method for waterproofing a substrate according to claim 1.

11. The method for waterproofing a substrate according to claim 7, wherein the adhesive member is adhered to the urethane-based waterproof layer before the adhesive interlayer is hardened.

12. A method for waterproofing a substrate, the method comprising:

adhering an adhesive member, which comprises an active hydrogen-containing synthetic resin impregnated with an isocyanate group-containing compound, to a urethane-based waterproof layer, to form a pavement adhesive layer; and paving an asphalt mixture on a surface of the pavement adhesive layer.

13. The method for waterproofing a substrate according to claim 12, wherein the active hydrogen-containing synthetic resin contains an ethylene-vinyl acetate copolymer resin.

14. The method for waterproofing a substrate according to claim 12, wherein a softening point of the active hydrogen-containing synthetic resin is lower than 60° C.

15. The method for waterproofing a substrate according to claim 12, wherein the adhesive member is in a woven fabric form, a non-woven fabric form, or a knitted form.

16. The method for waterproofing a substrate according to claim 12, wherein the molecular weight of the isocyanate group-containing compound is 800 or less.

17. The method for waterproofing a substrate according to claim 12, wherein a thickness of the adhesive member is 0.1 mm to 2 mm.

18. The method for waterproofing a substrate according to claim 12, wherein the adhesive member is adhered to the urethane-based waterproof layer using an adhesive interlayer positioned between the adhesive member and the urethane-based waterproof layer.

19. The method for waterproofing a substrate according to claim 18, wherein the adhesive member is adhered to the urethane-based waterproof layer before the adhesive interlayer hardens.

20. The method for waterproofing a substrate according to claim 12, wherein the active hydrogen originating from the active hydrogen-containing synthetic resin and the isocyanate group originating from the isocyanate group-containing compound react with each other for the first time when the adhesive member melts due to the application of the asphalt mixture.

21. A waterproof substrate formed from the method for waterproofing a substrate according to claim 12.

22. The method for waterproofing a substrate according to claim 18, wherein the adhesive member is adhered to the urethane-based waterproof layer before the adhesive interlayer is hardened.

* * * * *